United States Patent [19]

Henson

[11] Patent Number: 5,065,457

[45] Date of Patent: Nov. 19, 1991

[54] BODY PROTECTOR

[75] Inventor: Anthony E. Henson, Harbord, Australia

[73] Assignee: Albion Hat & Cap Company Pty., Ltd., Chippendale, Australia

[21] Appl. No.: 591,128

[22] Filed: Oct. 1, 1990

Related U.S. Application Data

[62] Division of Ser. No. 348,813, May 8, 1989.

[51] Int. Cl.[5] ..... A41D 13/00

[52] U.S. Cl. ..... 2/2; 2/16; 2/22; 2/24

[58] Field of Search ..... 2/2, 16, 22, 24, 44, 2/45, 92, 267, 268, DIG. 1

[56] References Cited

U.S. PATENT DOCUMENTS

| | | | |
|---|---|---|---|
| Re. 22,084 | 4/1942 | Lookabaugh | 2/2 |
| 653,544 | 7/1900 | Burns | 2/2 |
| 1,489,048 | 4/1924 | Whitley | 2/2 |
| 3,431,560 | 3/1969 | Austia | 2/2 |
| 3,446,880 | 5/1969 | Enicks | 2/2 |
| 3,867,726 | 2/1975 | Owl | 2/2 |
| 4,041,940 | 8/1977 | Frankel | 2/24 |
| 4,135,252 | 1/1979 | Latina | 2/2 |
| 4,185,327 | 1/1980 | Markve | 2/2 |
| 4,370,754 | 2/1983 | Donzis | 2/2 |
| 4,411,025 | 10/1983 | Magidson | 2/268 |
| 4,453,271 | 6/1984 | Donzis | 2/2 |
| 4,796,611 | 1/1989 | Wardlaw | 2/16 |
| 4,810,559 | 3/1989 | Fortier | 2/16 |
| 4,868,925 | 9/1989 | Mitchell | 2/2 |
| 4,868,926 | 9/1989 | Lowson | 2/22 |
| 4,985,931 | 1/1991 | Wingo | 2/2 |

FOREIGN PATENT DOCUMENTS

| | | | |
|---|---|---|---|
| 153082 | 8/1985 | European Pat. Off. | 2/2 |
| 246812 | 11/1987 | European Pat. Off. | 2/2 |
| 3530397 | 3/1987 | Fed. Rep. of Germany | 2/2 |
| 3719895 | 12/1988 | Fed. Rep. of Germany | 2/2 |
| 2587176 | 3/1987 | France | 2/24 |
| 1181619 | 9/1985 | U.S.S.R. | 2/2 |
| 664623 | 1/1952 | United Kingdom | 2/22 |
| 1560622 | 2/1980 | United Kingdom | 2/16 |

*Primary Examiner*—Werner H. Schroeder
*Assistant Examiner*—Diana L. Biefeld
*Attorney, Agent, or Firm*—Ladas & Parry

[57] ABSTRACT

The present invention discloses a body protector for sportsmen which allows prespiration from the sportsman's skin to be evaporated while the body protector is being worn. The protector takes the form of shoulder pads, a shin pad or a forearm pad. The protectors are molded from resiliently compressible plastic material and provided with a plurality of protrusions on their inner surface(s).

11 Claims, 6 Drawing Sheets

BODY PROTECTOR

This is a divisional of copending application Ser. No. 07/348,813 filed on May 8, 1989.

The present invention relates to body protectors for body contact sportsmen and, in particular, relates to body protectors such as shin pads and forearm pads.

Hitherto protective articles for sportsman which are intended to be worn under a gernsey/jumper, or within socks as is the case with shoulder pads and shin pads respectively, have suffered from the disadvantage that they are found to be excessively hot by the wearer. Given that the wearer is exerting himself in a body contact game, the wearer is generating a large amount of heat which must be dissipated in order for the wearer or sportsman not to feel discomfort.

Often such pads have been formed from cotton wadding which is sewn together with parallel extending seams something similar to those seen in cricket pads. Such seams create longitudinally extending grooves, however, these do not play any substantial role in keeping the sportsman cool.

One difficulty is that such body protectors must be able to be used in wet weather and therefore the outer covering of the body protector has hitherto been of water-proof material in order to prevent the cotton wadding becoming soaked through and thereby becoming both heavy in use and difficult to subsequently dry. This waterproof material often has the undesirable side effect of causing the skin of the sportsman to perspire profusely in contact with the material since the moisture intended to be evaporated from the sportsman's skin cannot be removed from adjacent skin and therefore remains unevaporated as perspiration.

It is the object of the present invention to provide a body protector for sportsman which can be used in wet weather and which seeks to enhance the natural ability of the body to evaporate perspiration.

According to one aspect of the present invention there is disclosed a body protector for a sportsman, said protector being moulded in a single piece from resiliently compressible plastics material and having a plurality of protrusions formed on its inner surface whereby air is able to circulate around adjacent protrusions between said inner surface and the skin of the sportsman.

According to another aspect of the present invention there is disclosed a shin pad or forearm pad for a sportsman, said pad comprising a plurality of elongate portions hingedly connected to lie alongside each other, there being a plurality of breather holes located between each pair of adjacent elongate portions, and the inner surfaces of said elongate portions comprising protrusions between which air is able to circulate between said inner surface and the skin of said sportsman.

A method of cooling a sportsman wearing a body protector is also disclosed.

One embodiment of the present invention will now be described with reference to the drawings in which.

Figure 1:
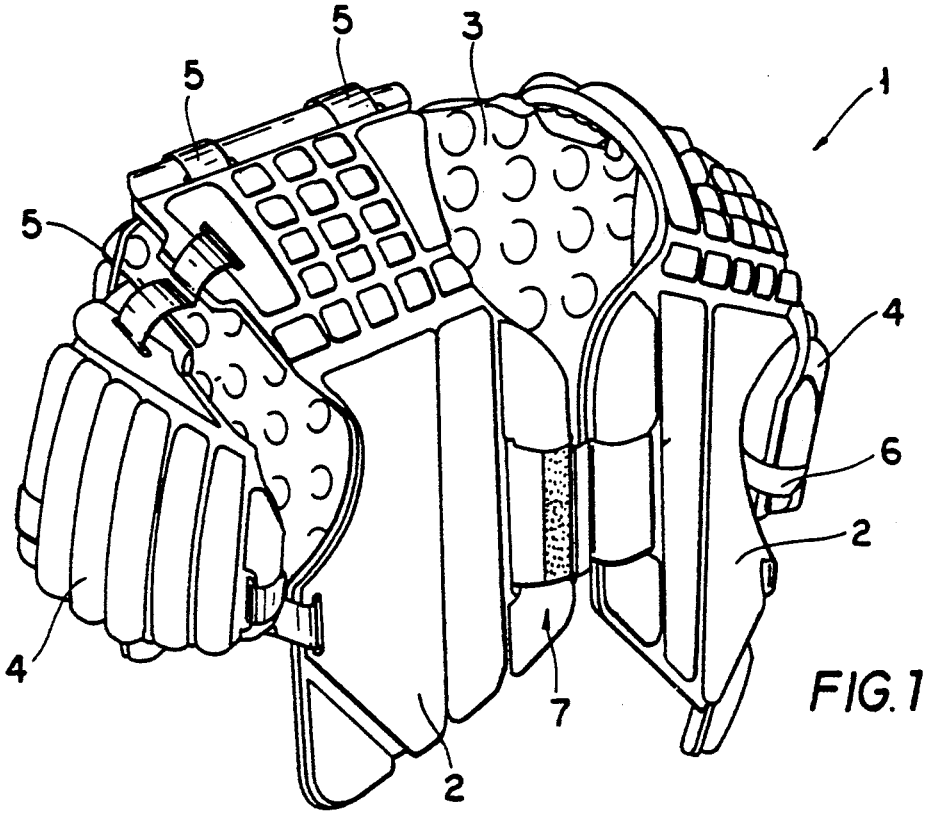
FIG. 1 is a perspective view of the shoulder pads of the preferred embodiment.
Figure 2:
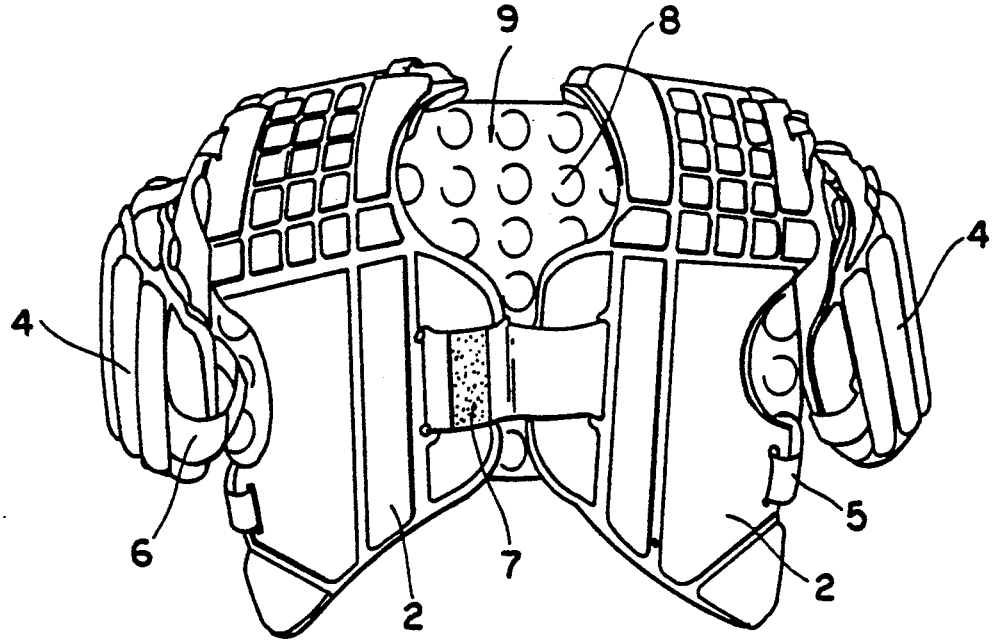
FIG. 2 is a front elevation of the shoulder pads of FIG. 1.
Figure 4:
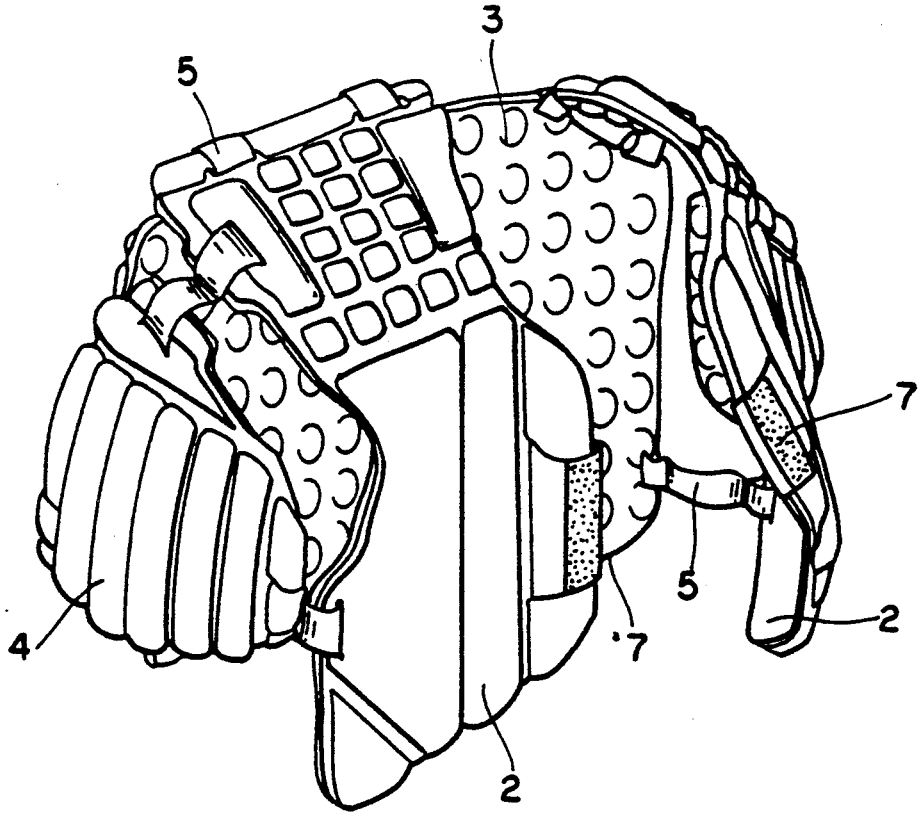
Figure 5:
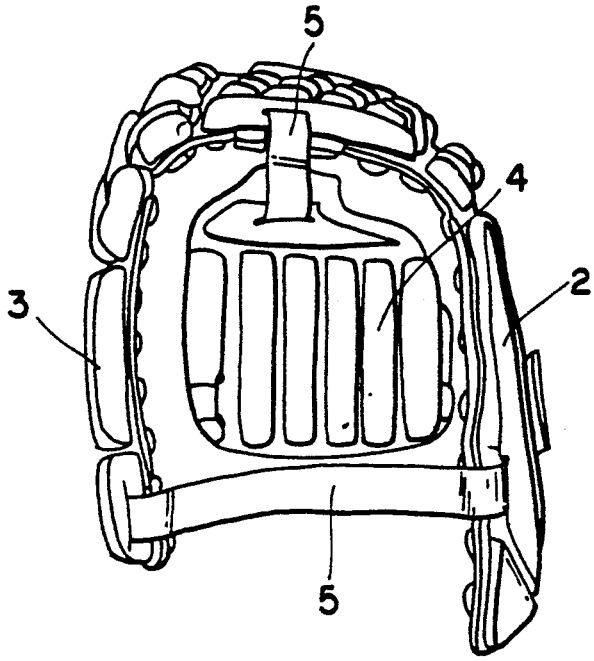
Figure 6:
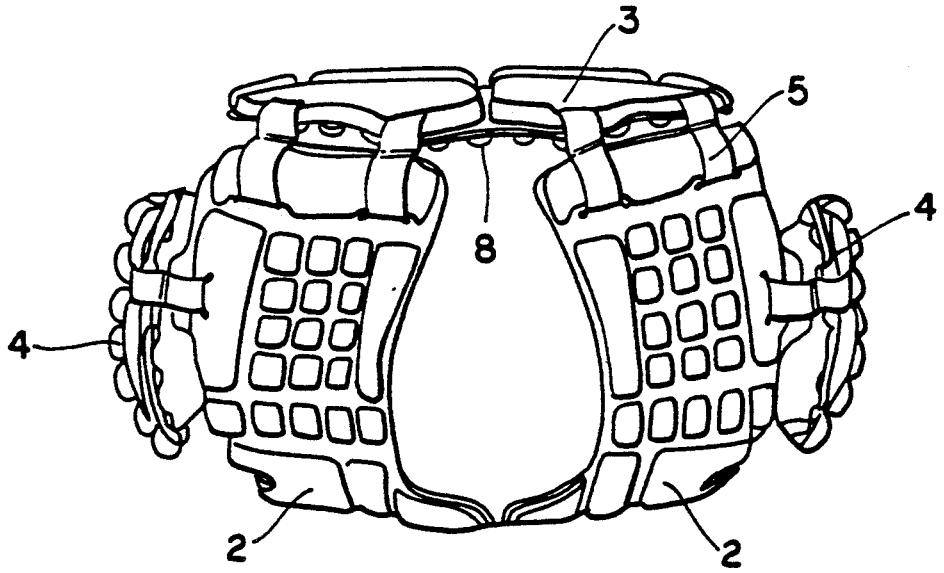
Figure 7:
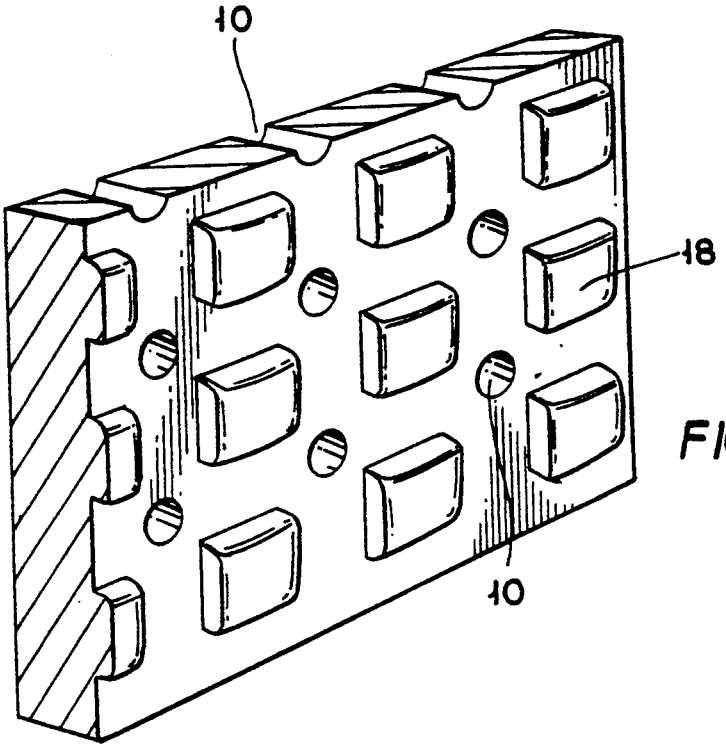
Figure 8:
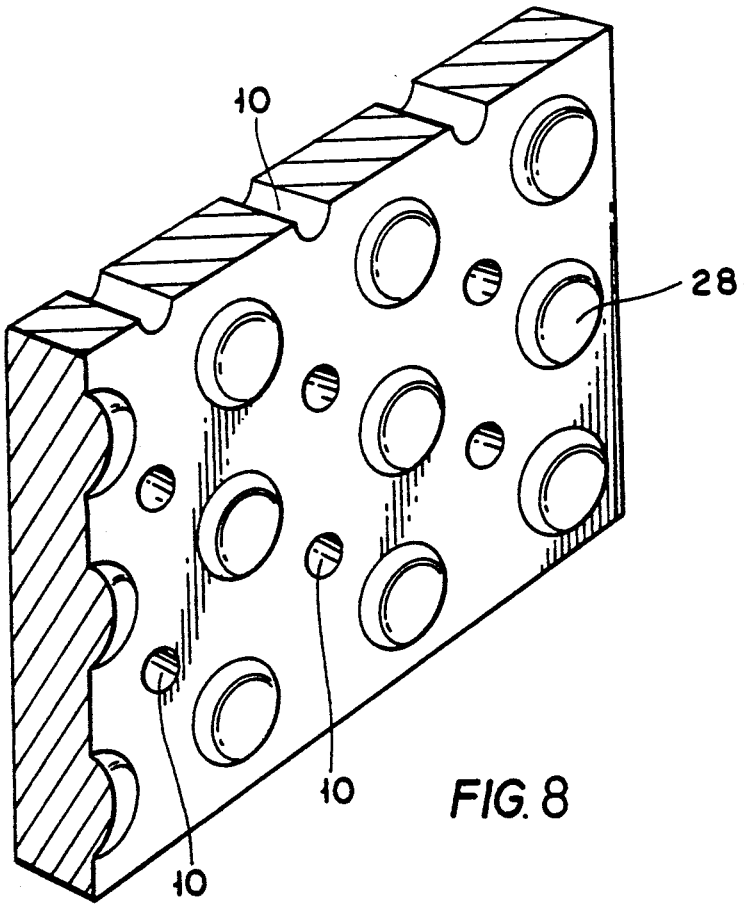
Figure 9:
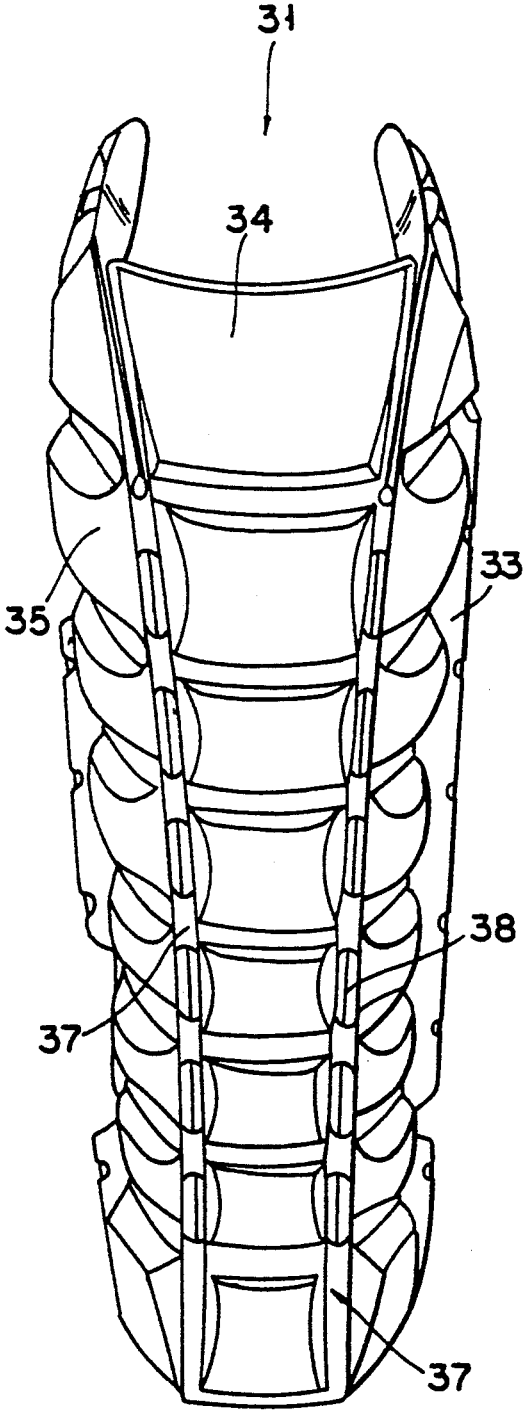
Figure 10:
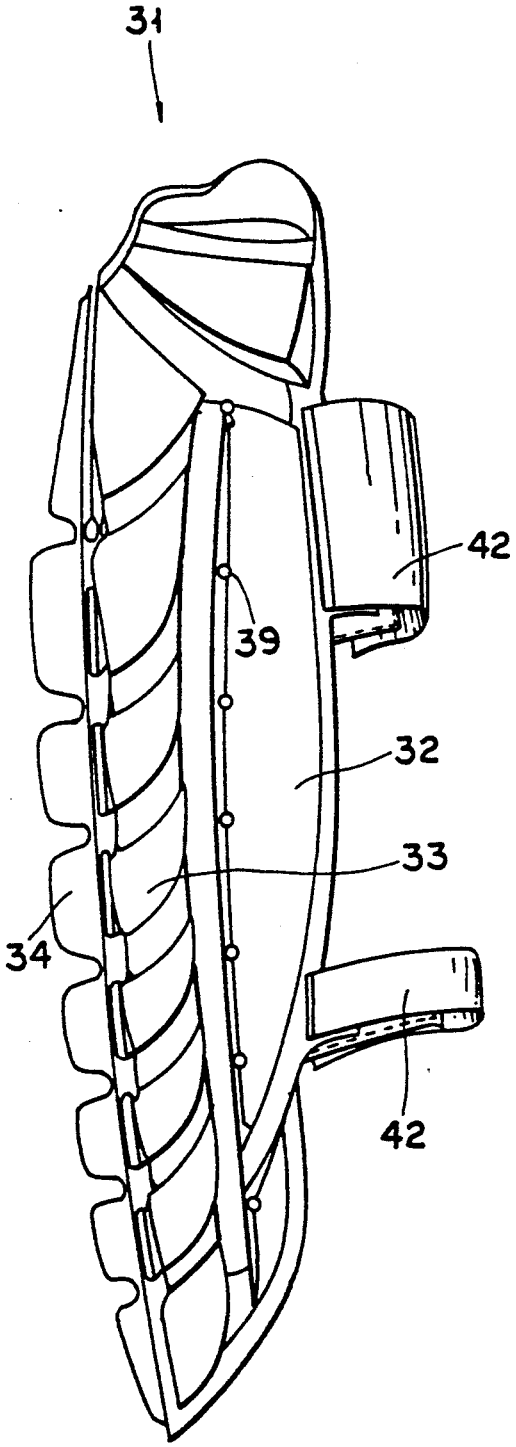
Figure 13:
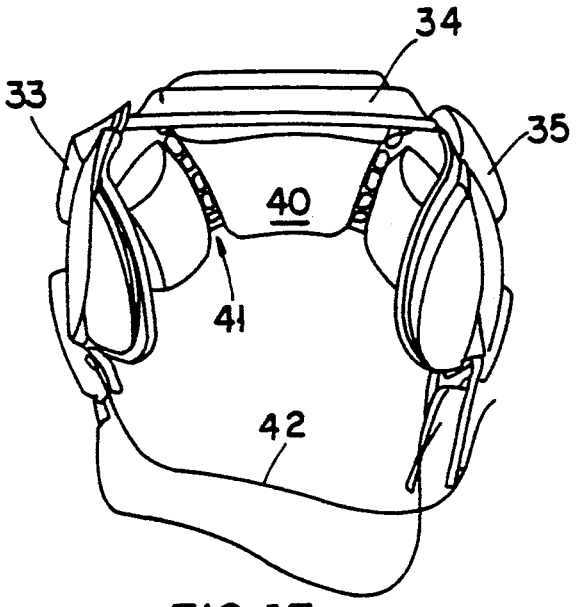
Figure 12:
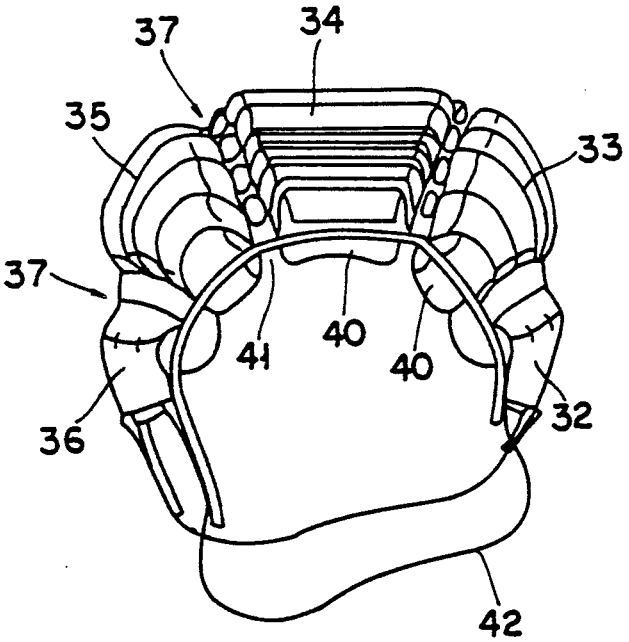
Figure 11:
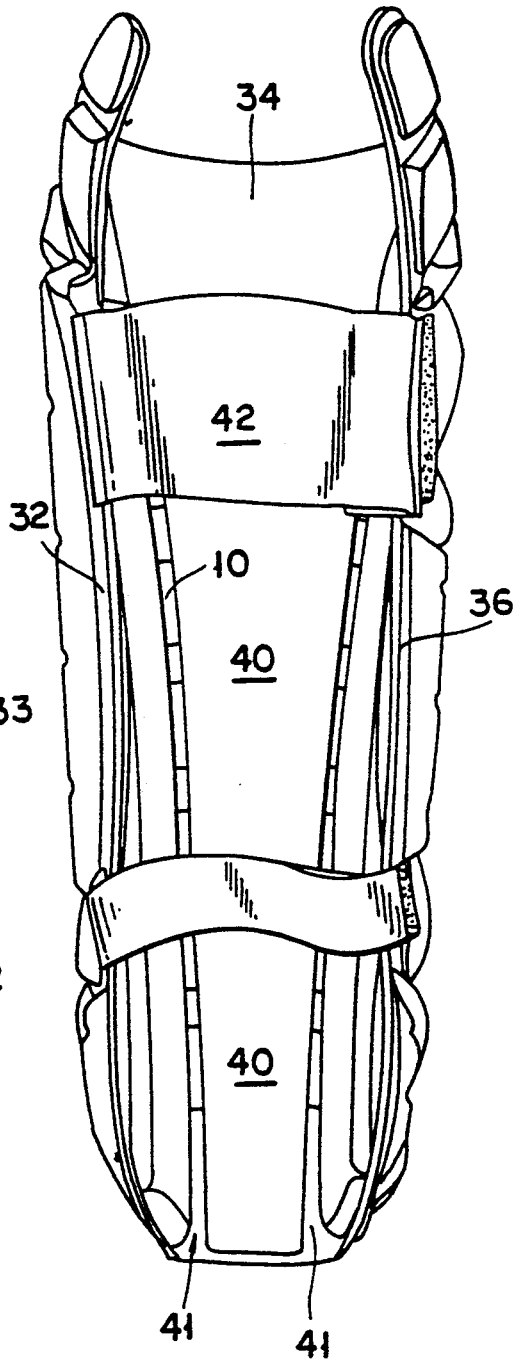

FIG. 4 is a perspective view of the shoulder pads of FIG. 1 showing the breast plates partially opened, FIG. 5 is a right side elevation of the shoulder pads of FIG. 1, FIG. 6 is a plan view of the shoulder pads of FIG. 1, FIG. 7 is a perspective view of one embodiment of the protector material, FIG. 8 is a view similar to FIG. 7 but of another embodiment of the protector material, FIG. 9 is a plan view of the shin pad or forearm pad of the preferred embodiment, FIG. 10 is a side elevation of the pad of FIG. 9, FIG. 11 is an inverted plan view of the pad of FIG. 9, FIG. 12 is an end view of the narrower end of the pad of FIG. 9, and FIG. 13 is an end view of the wider end of the pad of FIG. 9.

As seen in FIGS. 1 to 6, the shoulder pads 1 of the preferred embodiment comprise a pair of breast plates 2, a back plate 3 and two shoulder plates 4.

As seen in the drawings, the plates 2–4 are connected together by pliant fabric straps 5 which interconnect the plates and so arrange the plates to cover the shoulders and upper torso of the wearer (not illustrated). In addition, the shoulder plates 4 are provided with an arm-strap 6 which passes on the inside of the wearer's arm. The breast plates 2 are able to be joined together by means of a two piece VELCRO (Registered Trade Mark) fastener 7.

Each of the plates 2–4 is moulded in a single piece from a resilient plastics material such as polyurethane foam which is resiliently compressible and thus able to absorb some of the energy of contact.

Figure 3:
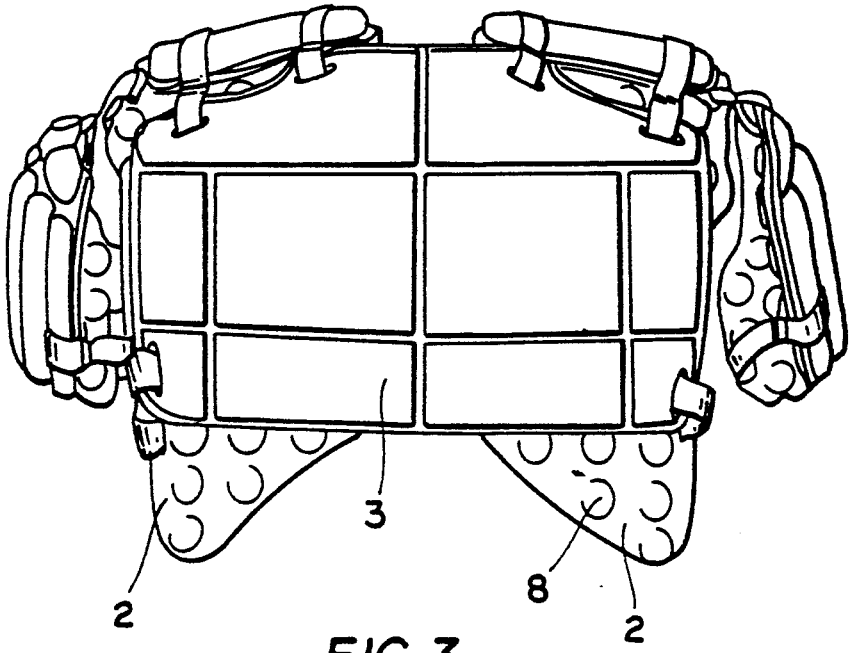
FIG. 3 is a rear elevation of the shoulder pads of FIG. 1.

As best seen in FIGS. 3 and 4, the inner surface 9 of each of the plates 2–4 is provided with a regular array of quasi-hemispherical protrusions 8. It is the tips of these protrusions 8 which come into contact with the skin of the wearer and thereby space the remainder of the inner surface 9 from the wearer's skin. As a consequence of this spacing, air is able to circulate between the inner surface 9 and the skin of the wearer by passing between the protrusions 8. This circulation of air enables the natural processes of evaporation to evaporate the perspiration liberated on the wearer's skin and thereby cool the wearer's skin.

Turning now to FIGS. 7 and 8 a representative slab of one of the plates 2–4 is illustrated showing the inner surface 9. In the embodiment illustrated in FIG. 7 the protrusions 18 are formed with a rectangular shape whereas in the embodiment illustrated in FIG. 8 the protrusions 28 are formed as flattened domes. Also illustrated in FIGS. 7 and 8 is a series of regularly spaced apertures 10 which pass directly through the plate material and which again assist the circulation of cooling air.

Turning now to FIGS. 9 to 13 inclusive, the shin pad 31 of the preferred embodiment is illustrated therein. The shin pad is moulded as a single article from foamed polyurethane and is formed from five elongate portions 32–36 which are connected together by grooves 37. Since the cross-sectional thickness of the polyurethane material at the base of the grooves 37 is substantially reduced, the grooves 37 each function as a hinge which interconnects the adjacent pair of elongate portions.

Located in the grooves 37 are a series of large breather holes 38 and a series of small breather holes 39. As best seen in FIGS. 12 and 13, the interior surface of each of the elongate portions 32–36 comprises a single elongate protrusion 40 against which the skin of the sportsman wearing the shin pad 31 bears. As a consequence, the protrusions 40 define a number of longitudinally extending channels 41 along which air is able to pass from adjacent the skin of the sportsman, through the breather holes 38, 39 and thence to the exterior of the shin pad 31. In this way, perspiration can be evaporated and removed from the sportsman, the latent heat of vaporization cooling the sportsman.

Preferably two fastening straps 42 are provided in order to enable a shin pad 31 to be securly located on each lower leg of the sportsman.

It will be apparent to those skilled in the art, that since the length of the lower leg is approximately equal to the length of the forearm, the shin pad 31 of FIGS. 9 to 13 can equally well be used as a fore arm pad. Such fore arm pads are particularly advantageous for sportsmen who have previously suffered a broken forearm since any further blows delivered to the forearm whilst protected by the pad, are distributed over the surface of the arm and therefore prevent any inadvertent concentration of force arising at the location of the previous break.

The foregoing describes only some embodiments of the present invention and modifications, obvious to those skilled in the art, can be made thereto without departing from the scope of the present invention.

What I claim is:

1. A body protector for a sportsman selected from the group consisting of a forearm pad and a shin pad, said protector being integrally formed, being molded from plastics material, and having an inner surface with a plurality of protrusions thereon, each of said protrusions being filled with said plastics material and the spaces between adjacent protrusions providing paths through which air is able to pass between said inner surface and the skin of said sportsman.

2. A body protector as claimed in claim 1 wherein said protrusions comprise regions between grooves formed in said inner surface.

3. A body protector as claimed in claim 2, wherein said grooves extend in the direction of said forearm or shin.

4. A body protector as claimed in claim 3, wherein said grooves comprise a hinged connection between said regions, said protector being able to be bent along said grooves to conform said protector to the shape of said forearm or shin.

5. A body protector as claimed in claim 4, wherein a corresponding groove in the outer surface of said protector is located opposite to, and aligned with, each of said grooves in said inner surface.

6. A body protector as claimed in claim 1, wherein said plastics material is resiliently compressible.

7. A body protector as claimed in claim 6, wherein said resilient plastics material is foamed.

8. A body protector as claimed in claim 7, wherein said resilient plastics material is polyurethane.

9. A body protector as claimed in claim 1, and having at least one aperture extending therethrough.

10. A body as claimed in claim 9, wherein said aperture is located in said grooves.

11. A body protector as claimed in claim 1, and having a pair of oppositely located securing straps to secure the protector to the user's body.

* * * * *